US006353953B1

(12) United States Patent
Tanaka et al.

(10) Patent No.: US 6,353,953 B1
(45) Date of Patent: Mar. 12, 2002

(54) RESIN CUSHIONING ELEMENT

(75) Inventors: Masao Tanaka; Shunji Kawando; Toru Shimazaki, all of Aichi-ken (JP)

(73) Assignee: Aisin Seiki Kabushiki Kaisha (JP)

( * ) Notice: Subject to any disclaimer, the term of this patent is extended or adjusted under 35 U.S.C. 154(b) by 0 days.

(21) Appl. No.: 09/427,712

(22) Filed: Oct. 27, 1999

(30) Foreign Application Priority Data

Oct. 28, 1998 (JP) ..... 10-307393

(51) Int. Cl.[7] ..... A47C 27/00
(52) U.S. Cl. ..... 5/723; 5/690; 5/719
(58) Field of Search ..... 5/723, 652, 690, 5/719, 420

(56) References Cited

U.S. PATENT DOCUMENTS 1,356,593 A * 10/1920 Bettiker ..... 5/420
3,513,491 A * 5/1970 Gordon ..... 5/723
4,868,940 A * 9/1989 Masadi ..... 5/420
5,303,438 A * 4/1994 Walker ..... 5/652
5,588,165 A 12/1996 Fromme
5,787,533 A 8/1998 Fromme

FOREIGN PATENT DOCUMENTS

EP 591322 A1 * 12/1992 ..... 5/690
FR 2293897 * 9/1976 ..... 5/400
GB 293086 * 6/1928 ..... 5/948
GB 2055173 * 2/1981 ..... 5/719

OTHER PUBLICATIONS

G. Hermann, "Slat Support for a Slatted Mattress", Abstract of EP 0366065, (May 2, 1990).

* cited by examiner

*Primary Examiner*—Alexander Grosz
(74) *Attorney, Agent, or Firm*—Finnegan, Henderson, Farabow, Garrett & Dunner, L.L.P.

(57) ABSTRACT

A resin-made cushioning element 1 which is of one-piece construction includes upstanding and downstanding portions 2*a* and 2*b* alternately arranged in regular manner to form a matrix having four peripheries.

5 Claims, 7 Drawing Sheets

RESIN CUSHIONING ELEMENT

BACKGROUND OF THE INVENTION

1. Field of the Invention

The present invention is directed to a element for mattresses, made of resin.

2. Description of the Related Art

A conventional resin cushioning element of the type is disclosed in, for example, U.S. Pat. No. 5,588,165. This resin cushioning element is formed of plastic and forms axially-oriented through chambers having ribs. When a load is applied on a top of the conventional resin cushioning element, the cushioning element deforms similar to a wire coil spring.

However, the foregoing conventional resin cushioning element has the inner ribs, so an inner structure of a cavity of a mold assembly becomes complex.

U.S. Pat. No. 5,787,533 also discloses another conventional resin cushioning element. However, this is similar to the foregoing conventional resin cushioning element in structure. Thus, complexity of the mold assembly is still a problem.

Accordingly, a need exists for a resin cushioning element without the foregoing drawback.

SUMMARY OF THE INVENTION

The present invention has been developed to satisfy the need noted above and thus has a primary object of providing a resin cushioning element which is of one-piece construction comprising upstanding and downstanding portions alternately arranged in a regular manner to form a matrix having four peripheral surfaces.

BRIEF DESCRIPTION OF THE DRAWINGS

The above and other objects, features and advantages of the present invention will be more apparent and more readily appreciated from the following detailed description of preferred exemplary embodiments of the present invention, taken in connection with the accompanying drawings, in which.

DETAILED DESCRIPTION OF THE PRESENT INVENTION

Preferred embodiments of the present invention will be described hereinafter in detail with reference to the accompanying drawings.

First of all, with references to FIGS. 1–5, there is illustrated a resin cushioning element 1 which is of one-piece construction. The resin cushioning element 1 includes cushioning portions 2 which are arranged regularly to constitute a matrix which is generally rectangular with five cushioning portions 2 in an X-direction and five cushioning portions 2 in a Y-direction.

The cushioning portion 2 is in the form of a convex or upstanding portions 2*a* when extending in the upward direction, while the cushioning portion 2 is in the form of a concave or downstanding portion 2*b* when extending in the downward direction. The upstanding portions 2*a* are identical in dimension, while the downstanding portions 2*b* are also identical in dimension. The upstanding portion 2*a* differs from the downstanding portion 2*b* only in the extending direction.

As a raw material of the resin cushioning element 1, which is of one-piece construction, a thermoplastic polyester elastomer is used which is supplied from TOYOBO under the name "PELEPRENE"®. Employing such a resin cushioning element 1 allows the same to be washed. The upstanding portion 2*a* is in the form of a hollow structure with its lower end open, while the downstanding portion 2*b* is in the form of a hollow structure with its upper end open. A preferred profile of each of the upstanding portion 2*a* and the downstanding portion 2*b* is a trapezoid. Making each of the upstanding portion 2*a* and the downstanding 2*b* into such a simple shape allows that when vertical forces are applied to the upstanding portion 2*a* and the downstanding portion 2*b* the resultant stresses diverge, thereby preventing stress concentrations. Such a simple shape of the cushioning element 1 which is of one-piece construction, has a result that the required molding device becomes more simple than the conventional one.

Figure 1:
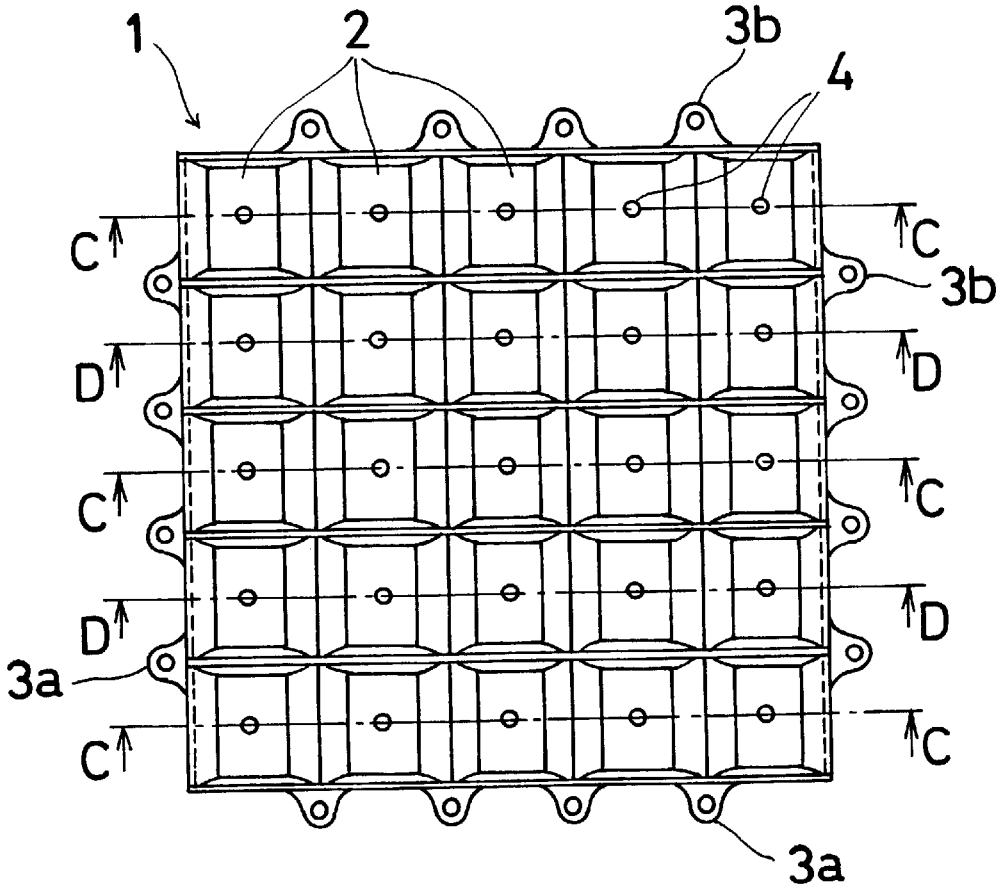
FIG. 1 is a top view of a resin cushioning element in accordance with a first embodiment of the present invention.
Figure 2:
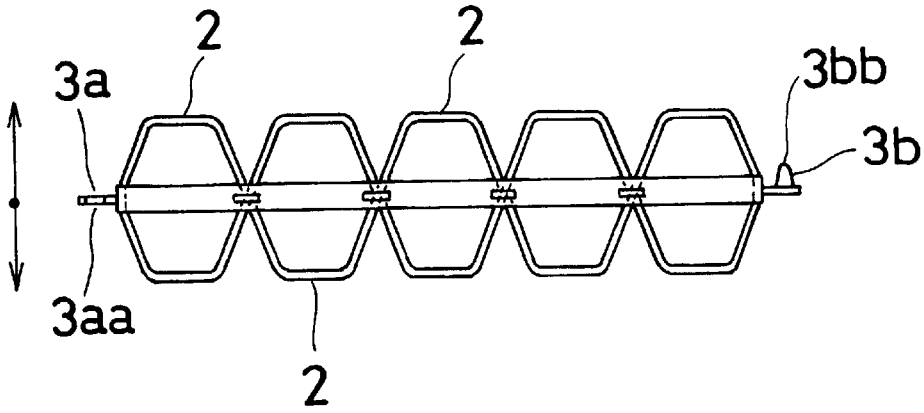
FIG. 2 is a side view of the resin cushioning element as viewed from the bottom in FIG. 1.
Figure 3:
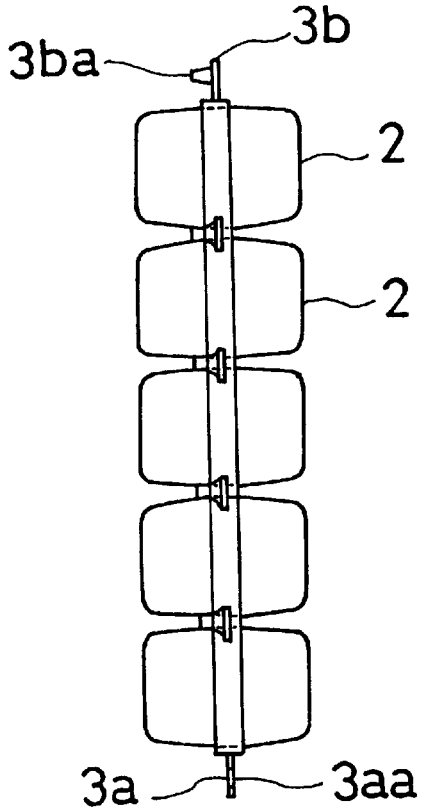
FIG. 3 is a side view of the resin cushioning element as viewed from the right in FIG. 1.
Figure 4:
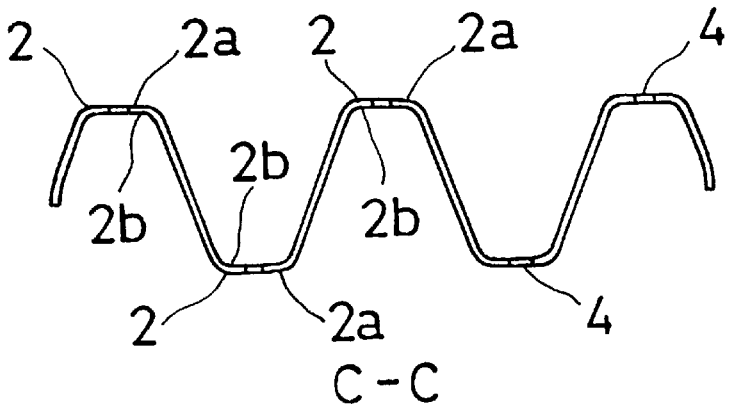
FIG. 4 is a cross-sectional view of the resin cushioning element taken along line C—C in FIG. 1.
Figure 5:
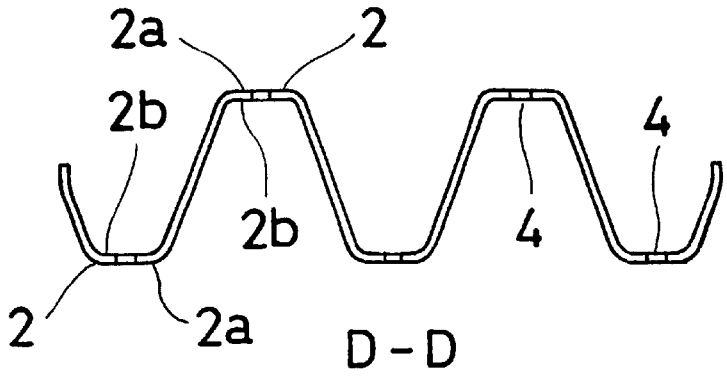
FIG. 5 is a cross-sectional view of the resin cushioning element taken along line D—D in FIG. 1.
Figure 6:
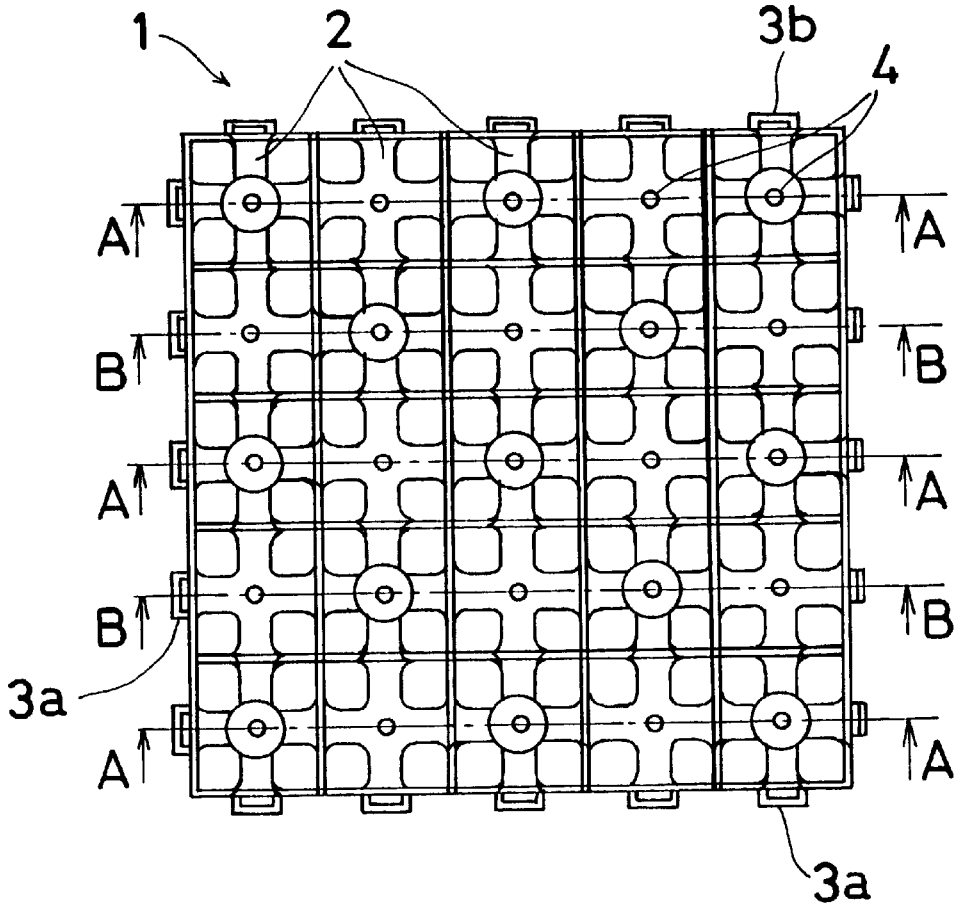
FIG. 6 is a top view of a resin cushioning element in accordance with a second embodiment of the present invention.
Figure 7:
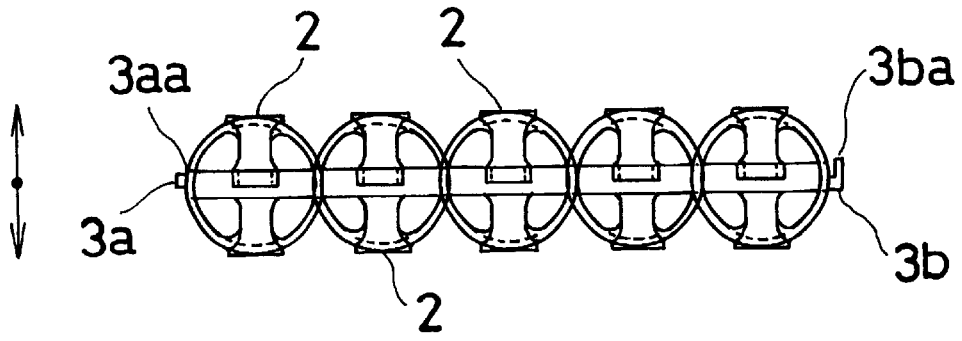
FIG. 7 is a side view of the resin cushioning element as viewed from the bottom in FIG. 6.
Figure 9:
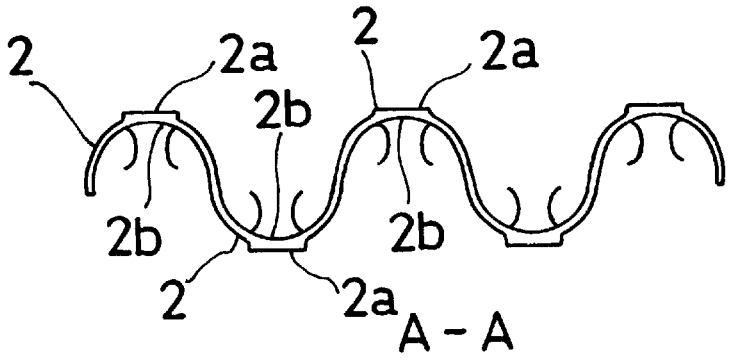
FIG. 9 is a cross-sectional view of the resin cushioning element taken along line A—A in FIG. 6.
Figure 10:
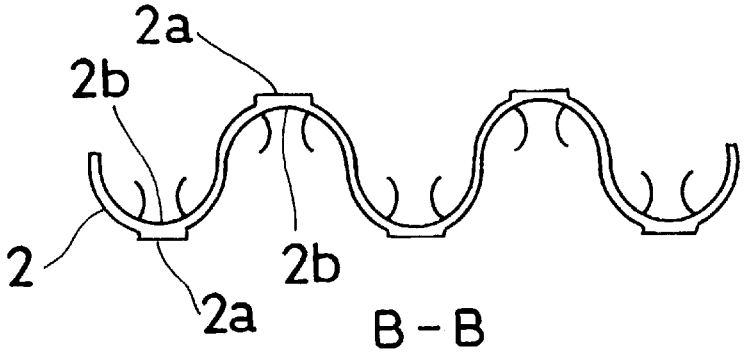
FIG. 10 is a cross-sectional view of the resin cushioning element taken along line B—B in FIG. 6.
Figure 8:
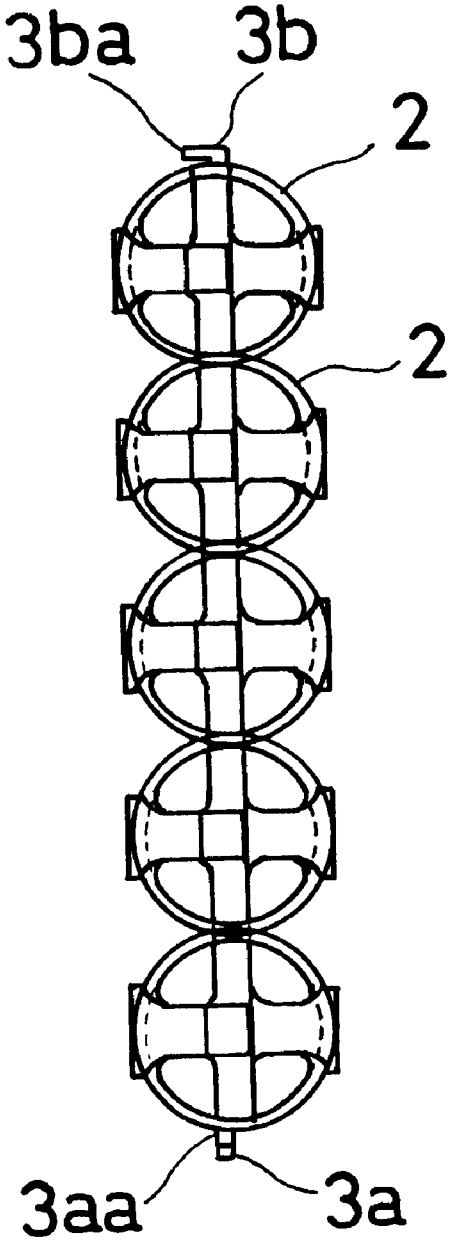
FIG. 8 is a side view of the resin cushioning element as viewed from the right in FIG. 6.

FIGS. 4 and 5 depict a series of the cushioning portions 2 wherein the upstanding portions 2*a* alternate with the downstanding portions 2*b* and another series of the cushioning portions 2 wherein the upstanding portions 2*a* alternate with the downstanding portions 2*b,* respectively, in such a manner that both series are out of phase by a half cycle (180 degrees). Because of this structure, the cushioning elements 1 can be stacked on one another. The softness can be adjusted according to the number of stacked cushioning elements 1.

The cushioning elements 1 have four peripheral surfaces: a pair of parallel lengthwise peripheral surfaces and a pair of parallel lateral peripheral surfaces. Along one of the lengthwise peripheral surfaces and the other of the lengthwise peripheral surfaces, a plurality of equally spaced connecting portions 3*a* and a plurality of equally spaced connecting portions 3*b* are provided, respectively. The connecting portion 3*a* has a hole 3*aa* and the connecting portion 3*b* has an integral upstanding pin 3*bb*. The pins 3*bb* of the cushioning element 1 are fitted, when another cushioning element is adjacent thereto, in the corresponding holes 3*aa* thereof. Employing such an engagement between two adjacent cushioning elements 1 allows construction of a cushion support

Figure 11:
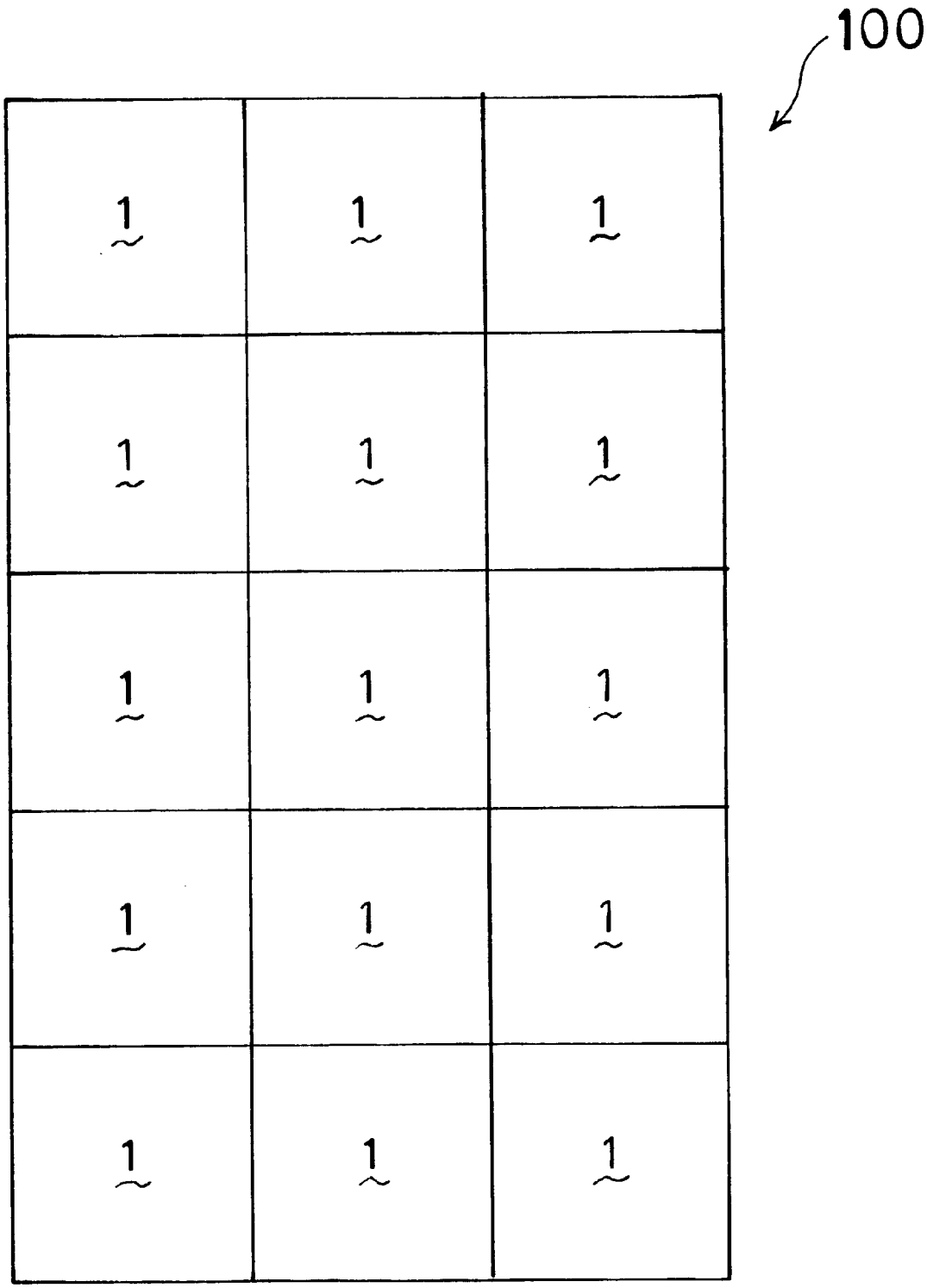
FIG. 11 is an outline view showing a cushion support as an arrangement of the cushioning elements in the form of a matrix.
Figure 12:
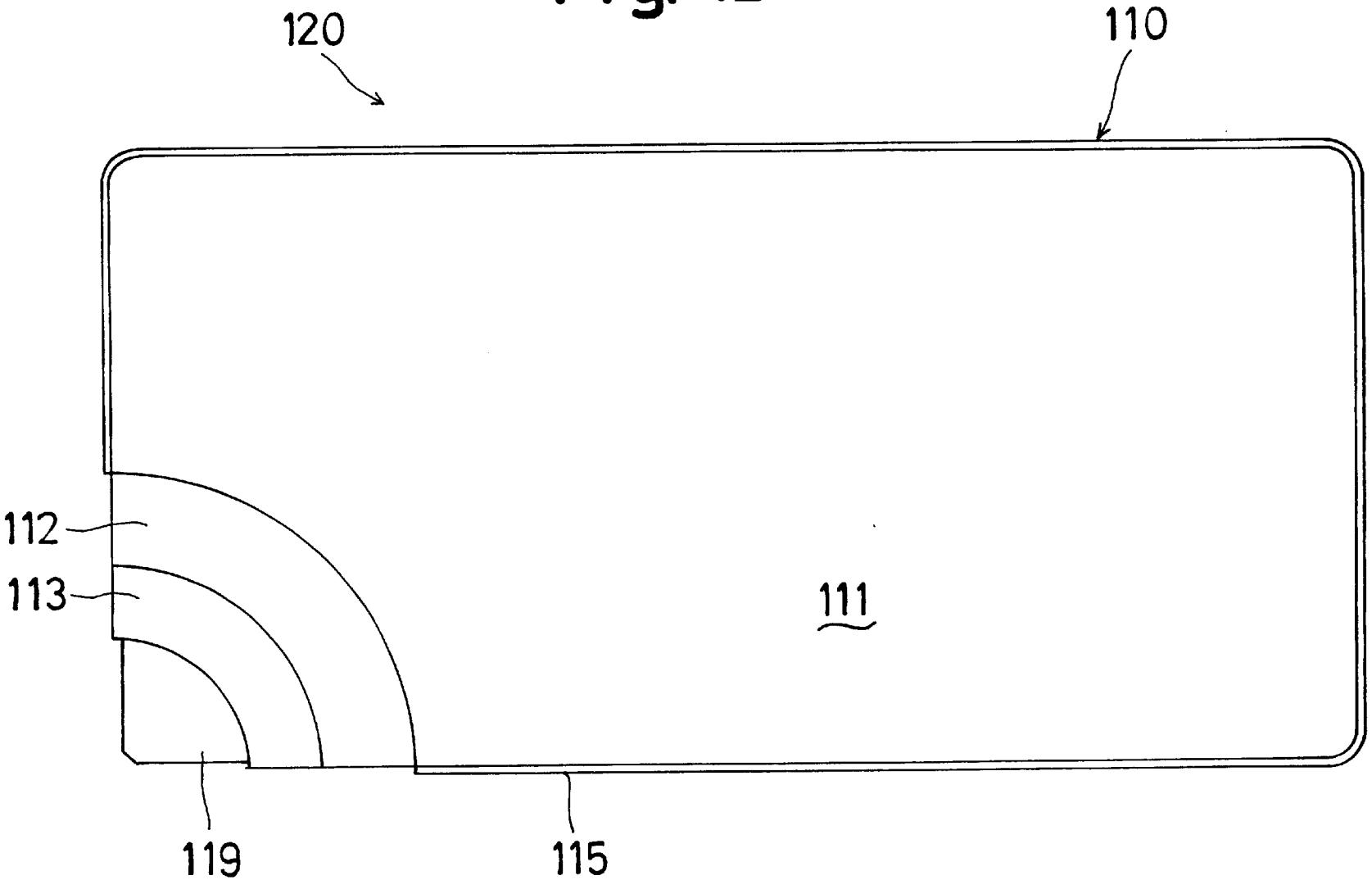
FIG. 12 is a top view of a cover assembly in which the cushion support shown in FIG. 11 is accommodated to constitute a mattress.

100 as shown in FIG. 11, and accommodating the resultant cushion support 100 is a cover assembly 110 establishing a mattress 120. The cover assembly 110 includes a base portion 119, a top portion 111, and a side wall portion 115 connecting therebetween. The top portion 111 is adhered at an inner side with two layered pad portions 112 and 113, which are mounted on the cushion support 100.

It is to be noted that adjusting the number of cushioning elements 1 can vary the longitudinal length and/or the lateral length depending on the demand. Of course, depending on this the dimensions of the cover assembly 110 can be adjusted. The cushion support 100 is an assembly of one-piece resin cushioning elements 1, which means that if the mattress 120 has to be shipped from the factory to another place, such shipment can be performed easily. The reason is that in such a shipment the cover assembly is handled in an expanded state in the form of the stacked cushioning elements 1. Thus, unlike conventional mattress shipment, the mattress 120 of the present invention is less bulky.

Instead of the trapezoid upstanding portion 2*a* (downstanding portion 2*b*), the hollow upstanding portion 2*a* (downstanding portion 2*b*) can be profiled in the shape of a dome which is constituted by a cross member. The dome has four angularly spaced apertures which allows the hollow upstanding portion 2*a* (downstanding portion 2*b*) to deform like a spring without concentrated stress. Upon piling the cushioning elements 1, a circular projection at a top of the lower sided dome receives an elastic portion in an upper sided dome, thereby preventing separation.

The invention has thus been shown and described with reference to specific embodiments, however, it should be understood that the invention is in no way limited to the details of the illustrated structures but changes and modifications may be made without departing from the scope of the appended claims.

What is claimed is:

1. A resin one-piece cushioning element comprising:

alternating upstanding and downstanding portions defining a matrix with peripheral surfaces;

each upstanding portion defining a dome having an open lower side and each downstanding portion defining a dome having an open upper side having a connecting portion;

wherein at least one peripheral surface includes a connecting portion, and each dome is provided with an aperture.

2. A resin cushioning element as set forth in claim 1, wherein each of the peripheral surfaces is provided with a connecting portion.

3. A resin cushioning element as set forth in claim 1, wherein each of the upstanding and the downstanding portions has a trapezoidal shape.

4. A resin cushion support comprising:

a plurality of resin cushioning elements disposed in rows and columns, each cushioning element having alternately upstanding and downstanding portions defining a matrix with four peripheral surfaces, at least some of the peripheral surfaces having connecting portions connecting two adjacent cushioning elements;

each upstanding portion including a hollow dome open at a lower end;

and each downstanding portion including a hollow dome open at an upper end;

wherein each dome is provided with an aperture.

5. A resin cushioning element as set forth in claim 4, wherein each of the upstanding and the downstanding portions has a trapezoidal shape.

* * * * *